US010993559B2

(12) United States Patent
Wolfe

(10) Patent No.: US 10,993,559 B2
(45) Date of Patent: May 4, 2021

(54) DRINKING VESSEL WITH UTENSIL COMPARTMENT

(71) Applicant: Ryan Wolfe, Orlando, FL (US)

(72) Inventor: Ryan Wolfe, Orlando, FL (US)

(73) Assignee: NOSU, INC., Orlando, FL (US)

( * ) Notice: Subject to any disclaimer, the term of this patent is extended or adjusted under 35 U.S.C. 154(b) by 74 days.

(21) Appl. No.: 16/503,448

(22) Filed: Jul. 3, 2019

(65) Prior Publication Data

US 2021/0000271 A1 Jan. 7, 2021

(51) Int. Cl.
*A47G 19/22* (2006.01)

(52) U.S. Cl.
CPC ..... *A47G 19/2205* (2013.01)

(58) Field of Classification Search
CPC ..... A47G 19/2205; A47G 19/22; A47G 19/2222; A47G 19/2266; A47G 19/30; A47G 21/145; A45F 3/16; B65D 1/04; B65D 23/00; A61J 7/0046
USPC .... 206/217, 766, 216, 218; 215/6, 386, 390, 215/388, 387
See application file for complete search history.

(56) References Cited

U.S. PATENT DOCUMENTS 1,240,072 A * 9/1917 Maiden ..... B65D 1/04 215/6
3,526,313 A * 9/1970 Breite ..... A47J 41/0083 206/217
3,624,787 A 11/1971 Newman
3,679,093 A 7/1972 Chang
4,930,637 A 6/1990 DeRoseau
5,042,712 A * 8/1991 DeRoseau ..... A47G 21/00 229/401
5,090,572 A 2/1992 DeRoseau
5,705,212 A * 1/1998 Atkinson ..... B65D 51/247 206/542
5,992,667 A * 11/1999 Huang ..... A47G 21/02 206/541
2001/0002673 A1* 6/2001 Huang ..... B65D 51/246 220/527
2005/0082295 A1* 4/2005 Jagger ..... A47G 19/2205 220/500
2008/0142520 A1* 6/2008 Morgan ..... B65D 23/12 220/254.3
2009/0045192 A1* 2/2009 Woolf ..... B65D 81/3205 220/23.87
2012/0175274 A1* 7/2012 Nowzari ..... B65D 23/14 206/217

(Continued)

FOREIGN PATENT DOCUMENTS

CN 201480401 5/2010
CN 103263190 8/2013

*Primary Examiner* — Rafael A Ortiz
(74) *Attorney, Agent, or Firm* — Mark Young, PA

(57) ABSTRACT

A drinking vessel with a hidden utensil compartment includes a cup with a recessed side extending from the bottom to a transition below the top. An elongated hollow structure defines a compartment and extends from the bottom against the recessed side. A base secured to the bottom of the cup includes an opening leading to the compartment. A sleeve-like cover contains the cup and the elongated hollow structure. A drawer holding utensils fits through the opening in the base into the compartment. A drawer stop attached to the recessed side includes a spring to facilitate removal of the drawer.

20 Claims, 20 Drawing Sheets

(56) References Cited

U.S. PATENT DOCUMENTS

| | | | | |
|---|---|---|---|---|
| 2012/0193248 | A1* | 8/2012 | Geter | A47G 23/0216 206/217 |
| 2014/0374370 | A1* | 12/2014 | Nowzari | B65B 5/06 215/6 |
| 2015/0298867 | A1* | 10/2015 | Sanderson | A47G 19/2266 215/6 |
| 2016/0198877 | A1* | 7/2016 | Ni | A45F 3/16 455/575.1 |
| 2018/0298909 | A1* | 10/2018 | Castle | F04D 17/16 |
| 2018/0334280 | A1* | 11/2018 | Ni | A45F 3/16 |
| 2019/0061984 | A1* | 2/2019 | Pell | A47G 19/2205 |

* cited by examiner

DRINKING VESSEL WITH UTENSIL COMPARTMENT

FIELD OF THE INVENTION

This invention relates generally to drinking vessels, and, more particularly, to a vessel with a hidden utensil compartment accessible from the bottom of the container.

BACKGROUND

The countless items of plastic waste polluting oceans, lakes, and rivers and piling up on land is more than unsightly, it is harmful to plants and wildlife. Single-use plastics, such as straws, utensils and plastic bottles, comprise a significant part of the pollution.

World plastics production increased from about an estimated 200 million metric tons in 2002 to 348 million metric tons in 2017, and continues to increase. Roughly half of annual plastic production is destined for single-use products, which include plastic straws, bottles, cups and utensils. Only a small portion is ever recycled, with the balance ending up in landfills, oceans, and elsewhere.

As one example, more than 480 billion plastic drinking bottles were sold in 2016 across the world, up from about 300 billion a decade ago. By 2021 this amount is expected to increase to 583.3 billion. Most plastic bottles used for beverages are made from polyethylene terephthalate (PET), which is highly recyclable. But as their use soars, efforts to collect and recycle the bottles are failing to keep up. Fewer than half of the bottles are collected for recycling and a small percentage of those collected are turned into new bottles. Most plastic bottles produced end up in landfill or in the ocean. The percentages of plastic straws, cups and utensils that are collected and recycled are even lower. As these items tend to be discarded as trash, with other food waste.

Efforts have been made to devise containers with a compartment for storing utensils. Cups or similar containers with a lid having a storage compartment in which one or more utensils are contained are describe in U.S. Pat. Nos. 3,624,787, 3,679,093, 4,930,637, 5,042,712, 5,090,572, 5,705,212 and 5,992,667 and US Patent Application Publication 20010002673. Many of these are disposable cups or containers packaged with disposable utensils. They are part of the problem. They do not provide a means for storing utensils in a cup while the cup is used and remains fully functional. They do not provide means for removing, restoring and securing the utensils in a separate compartment. They do not solve the problem of single use disposable plastic utensils and cups.

A cup with a compartment for holding utensils should allow use of the cup while the utensils are stored or removed. Such a cup should store the utensils in a compartment apart from the beverage compartment of the cup. The compartment containing the utensils should not interfere with use of the cup. Such a cup should securely hold the utensils, preventing rattling of the utensils when the cup is moved. The compartment containing the utensils should include a closure to prevent soiling and contamination. The utensils should be easy to remove from the compartment. Used utensils should be storable in the compartment without soiling the compartment.

The invention is directed to overcoming one or more of the problems and solving one or more of the needs as set forth above.

SUMMARY OF THE INVENTION

To solve one or more of the problems set forth above, in an exemplary implementation of the invention, a drinking vessel assembly includes a compartment for storing utensils. The assembly includes a drinking cup with a recessed side, an outer cover, a compartment module, a drawer and utensils. The drinking cup and a substantial portion of the compartment module are received in the outer cover. The compartment module includes a compartment. When the compartment module is installed, the compartment is disposed between the recessed side of the drinking cup and the outer cover. The compartment module includes a bottom with an opening that leads to the compartment. A movable panel on the bottom of the compartment module can be moved (e.g., pivoted) to a closed or open position. In the closed position, the panel covers the opening. In the open position, the panel exposes the opening. The utensils are stored in a drawer. Edges of the utensils are retained in flexible tabs in the drawer. The drawer is sized and shaped to receive the utensils and slide into the compartment through the bottom opening. When retained in the drawer, the utensils contact the interior of the drawer, but do not contact the compartment. Thus a used utensil will not soil the compartment. The drawer and utensils may be removed for use of the utensils and for cleaning of the utensils and drawer. To facilitate insertion into the compartment and removal from the compartment, a drawer stop with a spring (e.g., leaf spring) is provided in the compartment at a distance from the bottom opening at least as great as the length of the drawer. The drawer cannot be inserted beyond the stop. The spring applies a force against the inserted drawer. The force urges the drawer towards the opening. When the panel is moved to the open position, the spring urges the drawer out of the compartment until the spring has reached its fully extended (uncompressed) position. When the panel is moved to the closed position, the spring urges the drawer against the panel, which causes friction that helps keep the panel in the closed position. Other elements, such as a detent, may help keep the panel in an open position and/or closed position until overcome by sufficient force.

An exemplary drinking vessel assembly according to principles of the invention includes a cup having an open top leading to a space for containing a liquid, a bottom, and a recessed side extending from the bottom to a transition between the top and the bottom. A compartment module includes a base and an elongated hollow structure defining a compartment. Alternatively, the base and elongated hollow structure may be separate components, rather than parts of a module. The base abuts the bottom of the cup and includes an opening leading to the compartment. Attachments secure the base to the bottom of the cup. The attachments may include screws, mating sockets and plugs, welds, or glue. The elongated hollow structure extends from the base and against the recessed side of the cup. A sleeve-like cover with a circular cross-section shape includes an open top, an open bottom and an interior space extending from the open top to the open bottom. The cover is sized and shaped to receive and contain the cup and the elongated hollow structure against the recessed side of the cup. A portion of the base is received in the open bottom of the cover. The compartment defined by the elongated hollow structure may have a D-shaped cross-section. A drawer is sized and shaped to slide through the opening in the base and into the compartment defined by the elongated hollow structure. At least one utensil is removably coupled to the drawer. A plurality of attachments (e.g., slotted tabs) may be provided to releasably attach the utensil to the drawer. The utensils may be a fork, a spoon, a knife, a straw, chopsticks or other eating or drinking utensil. The drawer may include a drawer panel having a top end and a bottom end, a top flange extending orthogonally from the top end of the drawer panel, and a bottom flange extending orthogonally from the bottom end of the drawer panel. The drawer may further include a pair of side flanges perpendicular to the top flange and the bottom flange. A closure may be provided over the opening in the base. In one embodiment, the closure is a pivoting panel that is movable from a closed position covering the opening in the base to an open position exposing the opening in the base.

The elongated hollow structure may have an open top end. A drawer stop may be attached to the recessed side of the cup between the open top end of the elongated hollow structure and the open top of the cup. The drawer stop comprising a structure that impedes insertion of the drawer beyond the drawer stop. The drawer stop may include a spring (e.g., a leaf spring which may be integrally formed with a portion of the drawer stop) extending from the drawer stop towards the bottom of the cup. In one embodiment, the drawer stop includes a vertical panel and a horizontal panel extending perpendicular from the vertical panel, with the spring extending from the horizontal panel.

BRIEF DESCRIPTION OF THE DRAWINGS

The foregoing and other aspects, objects, features and advantages of the invention will become better understood with reference to the following description, appended claims, and accompanying drawings, where:

Those skilled in the art will appreciate that the figures are not intended to be drawn to any particular scale; nor are the figures intended to illustrate every embodiment of the invention. The invention is not limited to the exemplary embodiments depicted in the figures or the specific components, configurations, shapes, relative sizes, ornamental aspects or proportions as shown in the figures.

DETAILED DESCRIPTION

Figure 1:
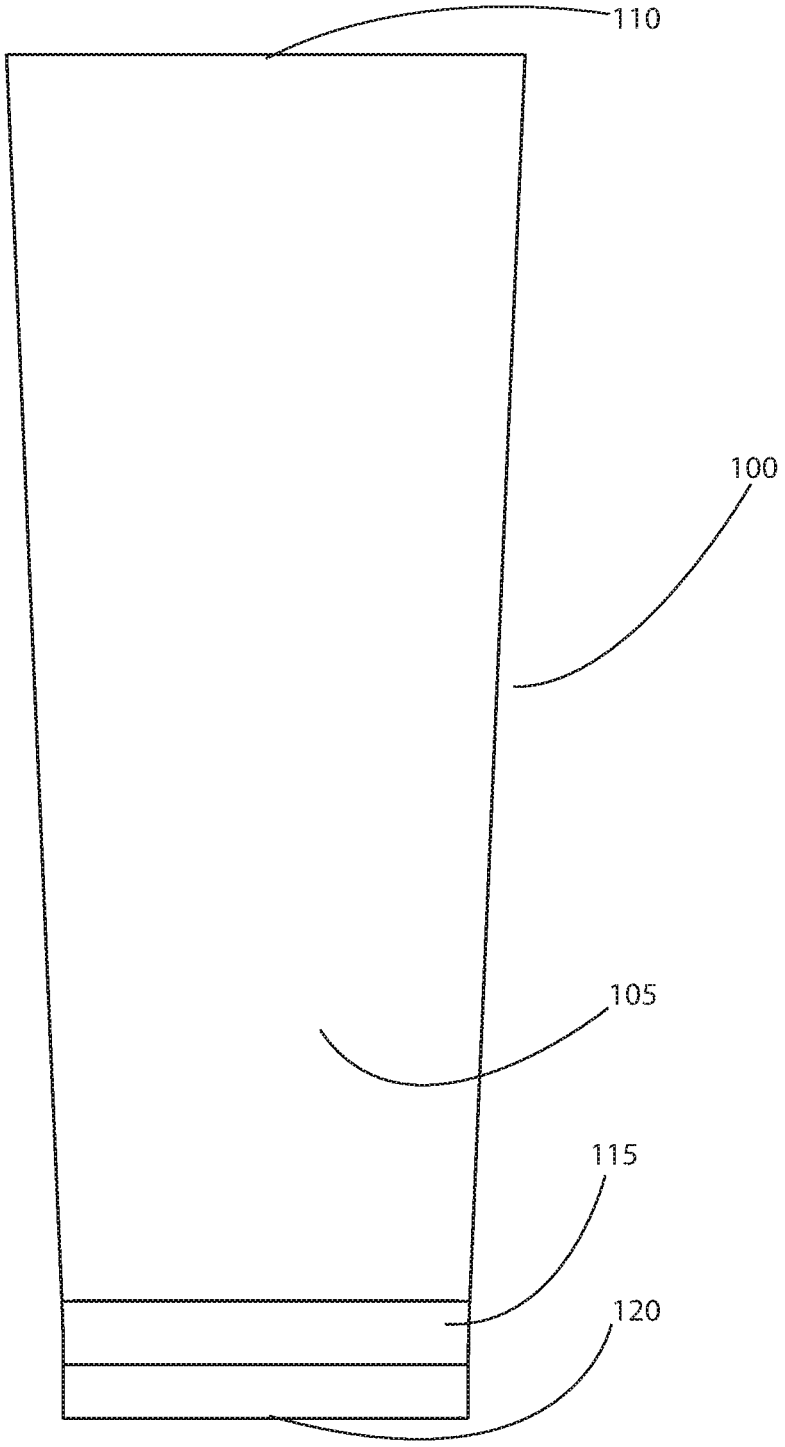
FIG. 1 is a side view of an exemplary drinking vessel according to principles of the invention.
Figure 2:
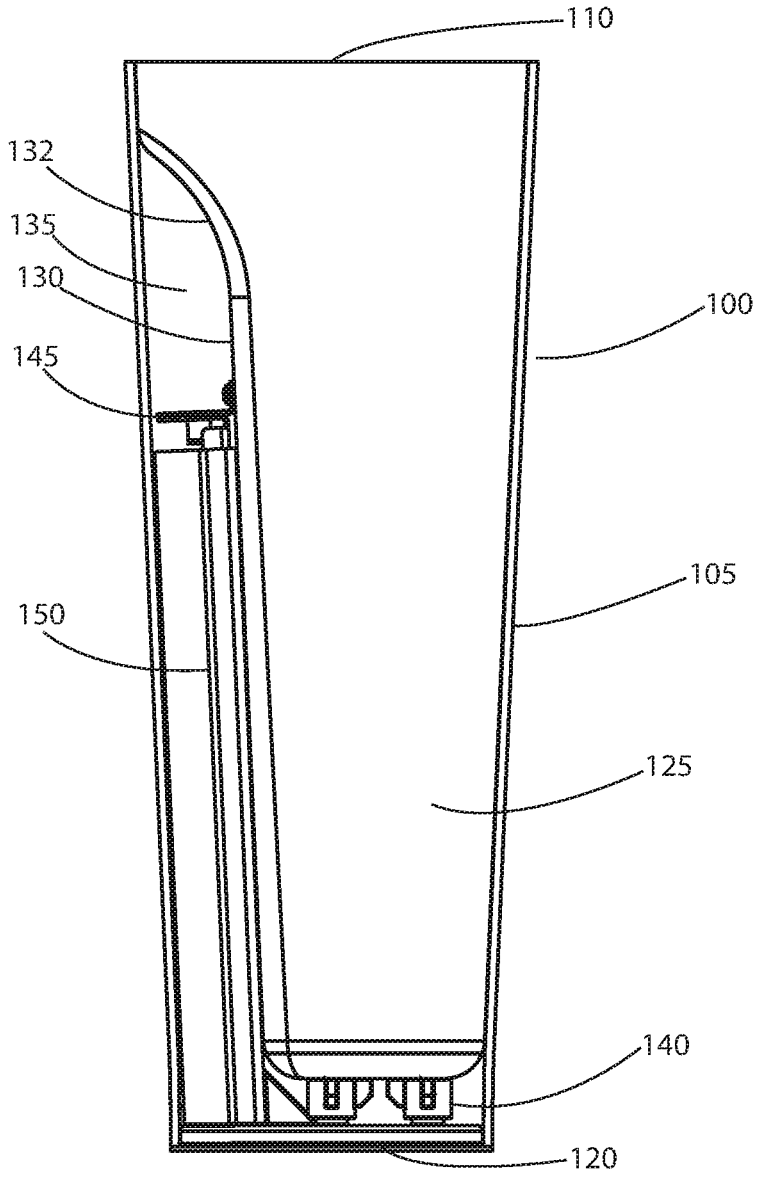
FIG. 2 is a side view of an exemplary drinking vessel, with a section of the outer cover, exposing components within the outer cover, according to principles of the invention.

A drinking vessel assembly 100 according to principles of the invention includes a compartment for storing utensils. The assembly includes a drinking cup with a recessed side, an outer cover, a compartment module, a drawer and utensils. The drinking cup and a substantial portion of the compartment module are received in the outer cover. The side view of FIG. 1 conceptually illustrates the outer cover 105. The outer cover 105 is a hollow sleeve with a larger diameter at the top 110 than at the bottom 115. The top 110 and bottom 115 of the cover 105 are open. The cover 105 provides a housing to contain the drinking cup, drawer and utensils, and substantially contain the compartment module. A bottom portion 120 of the compartment module is exposed.

The drinking cup 125 includes an outer surface and an interior surface. The interior surface defines a space that may contain a beverage. In a nonlimiting exemplary embodiment, the drinking cup is a double-walled vessel. By way of example and not limitation, the drinking cup 125 may be a double-walled stainless steel vessel, with insulation, evacuated space, air or another gas between the walls. Alternatively, the drinking cup may be single walled. As another alternative, the drinking cup may be comprised of glass or a plastic that is safe for food contact. Nonlimiting examples of such plastics include polyethylene terephthalate, high density polyethylene, low density polyethylene and polypropylene.

As shown in FIGS. 2, 3, 8 and 9, the drinking cup includes a recessed exterior side 130. The recessed exterior side 130 of the drinking cup 125 and the outer cover 105 define a space 135 for receiving a compartment 150 (i.e., a hollow elongated structure with an open top). The top 110 (FIG. 3) of the drinking cup 125, which is not recessed, has a larger diameter or width than the diameter or width of the portion of of the cup 125 with the recessed side. As the top 110 of the cup 125 is not recessed, a user may drink from any side of the cup 125.

In the exemplary embodiment shown in the FIGS. 2, 3, 8 and 9, the cup 125 transitions 132 from non-recessed to recessed about 10% to 20% of the total height of the cup 125 below the top 110 of the cup 125. The recessed side 130 continues from the transition 132 to the bottom of the cup 125. The point at which the transition 132 is made, the shape of the transition 132, and the depth of the recess may vary considerably within the scope of the invention. The point at which the transition 132 is made, the shape of the transition, and the depth of the recess may be determined to facilitate manufacture and assembly while providing sufficient space to receive a compartment 150 for storing a drawer containing utensils. By way of example and not limitation, the transition 132 may comprise a sharp bend or a bend with a radius as illustrated in FIGS. 2, 3, 8 and 9.

The compartment module includes a compartment 150. When the compartment module is installed, the compartment 150 is disposed in the space 135 between the recessed side 130 of the drinking cup 125 and the outer cover 105, below the tops 110, 112 of the drinking cup 125 and the outer cover 105. The compartment 150 is a chamber with an interior space 153 (FIG. 4) in which a drawer 200 (FIG. 6) for containing utensils 240-250 may be stored. Thus, the compartment 150 is sized and shaped to fit in the space 135 and to receive the drawer 200 for containing utensils 240-250.

When assembled, the bottom 128 of the drinking cup 125 is secured to a base 120 of the compartment module. In the exemplary embodiment, the bottom 128 of the drinking cup 125 includes sockets 140 for receiving fasteners to secure the bottom 128 to a base 120 of the compartment module. The sockets 140 are sized to mate with plugs 124 extending from the base 120 of the compartment module. Screws 122 (FIG. 3) extend through the plugs 124 into the sockets 140. Fasteners (i.e., attachments) other than plugs and sockets, such as, but not limited to snap fit connections, rivets, screws, welds and glue may be used in addition to or in lieu of the plugs 124 and sockets 140. The plugs 124 and sockets 140 may be integrally formed with the base 120 and cup 125, respectively, or they may be formed separately and attached to the base 120 and bottom 128 of the cup 140. Each socket 140 may securely contain a threaded nut or contain internal threads for engagement by screws 122.

As shown in FIGS. 2, 3, 8 and 9, the recessed side 130 of the drinking cup 125 includes a drawer stop 145. The drawer stop 145 limits insertion of drawer 200 into the compartment. 150. The top 152 (FIG. 4) of the compartment 150 is open. The drawer stop 145 may be attached to the recessed side 130 of the drinking cup 125 at a point about equal to the top 152 of the compartment 150, or slightly higher. Thus, the end of the drawer 200 may extend slightly beyond the top 152 of the compartment 150.

Figure 10:
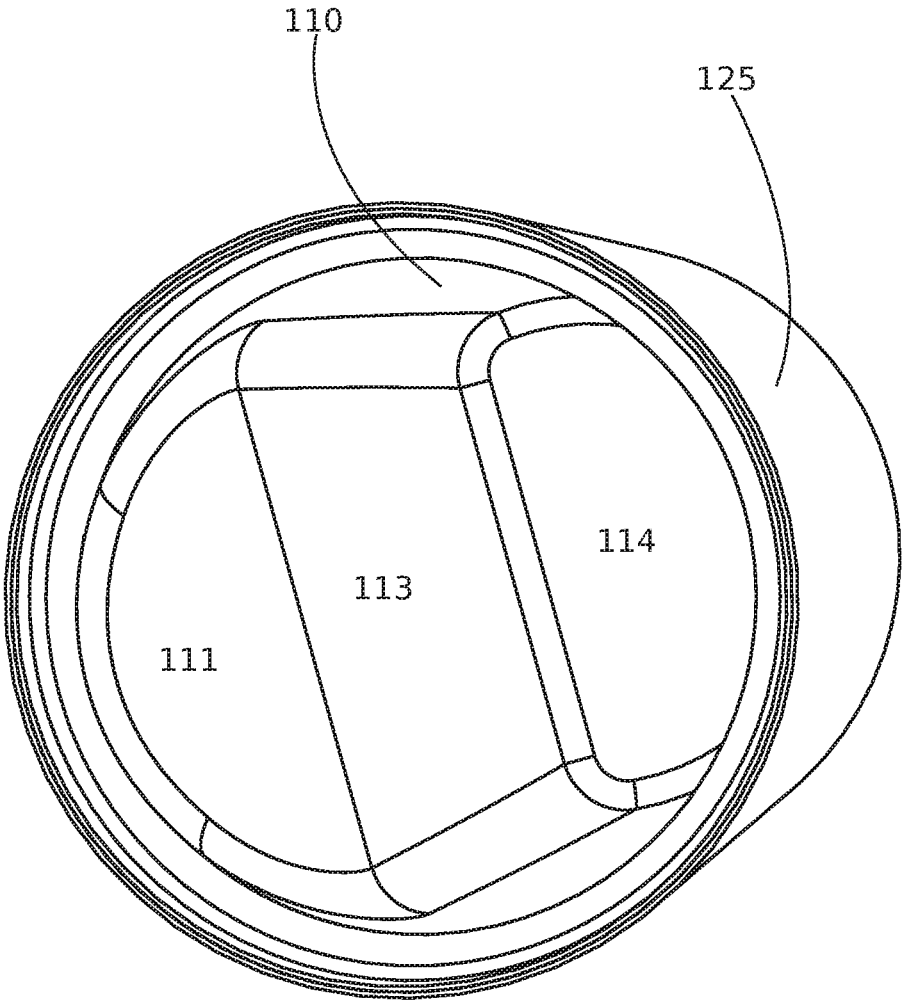
FIG. 10 is a third perspective view of a double walled cup with an attached drawer stop and leaf spring for a drinking vessel according to principles of the invention.

FIG. 10 conceptually illustrates an interior compartment of the cup 125. The cup may contain a liquid substance such as a beverage or soup. The interior section 111 coincides with the transition 132. The interior section 113 coincides with the recessed portion 130. The interior bottom 114 corresponds to the bottom 128 of the cup 125.

An exemplary drawer stop 145 is right angled structure, with a vertical panel 147 fastened to the recessed side 130 of the drinking cup 125. A horizontal panel 144 defines the limit of drawer 200 insertion. In the exemplary embodiment, a leaf spring 146 is formed in the horizontal panel 144 by a U-shaped cut in the panel, with the inner piece forming the spring 146 being bent downwardly, extending below the horizontal panel 144. The drawer 200 cannot be inserted beyond the stop 145. The spring 146 applies a force against the inserted drawer 200. The force urges the drawer 200 towards the opening. The stop 145 may be formed of metal or plastic. When the panel 160 is moved to the closed position, the spring urges the drawer 200 against the panel 160, which causes friction that helps keep the panel in the closed position. Other elements, such as a detent, may help keep the panel in an open position and/or closed position until overcome by sufficient force.

Figure 8:
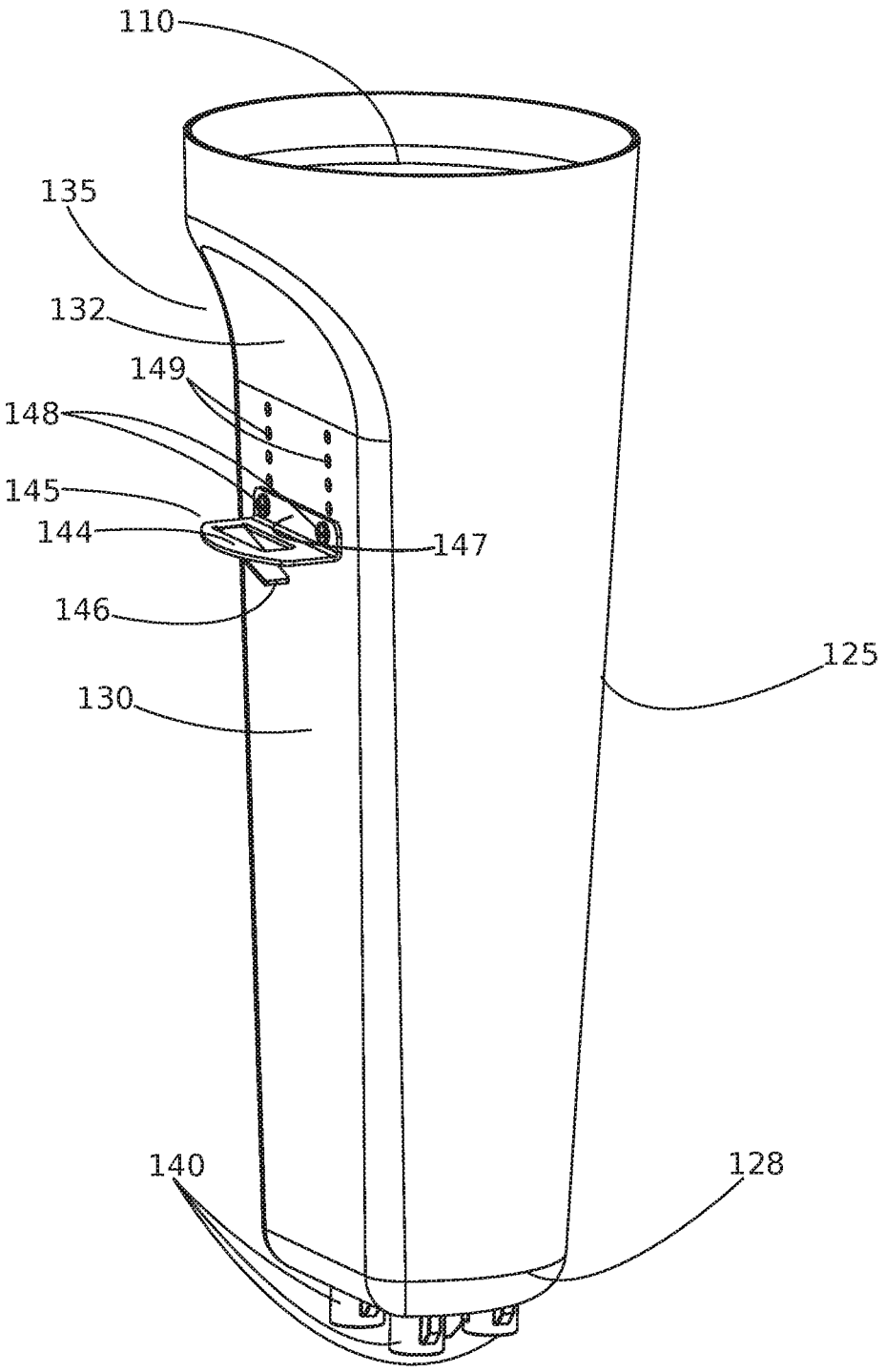
FIG. 8 is a first perspective view of a double walled cup with an attached drawer stop and leaf spring for a drinking vessel according to principles of the invention.
Figure 9:
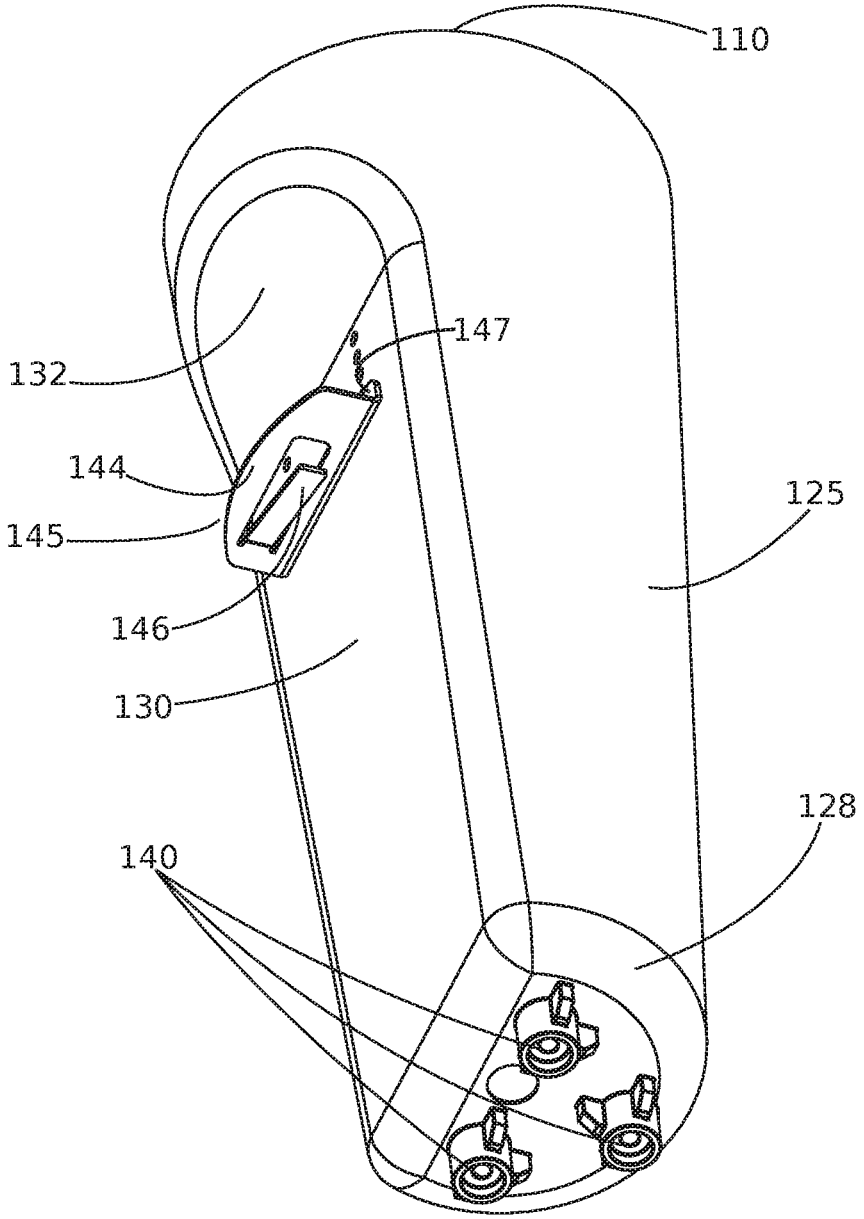
FIG. 9 is a second perspective view of a double walled cup with an attached drawer stop and leaf spring for a drinking vessel according to principles of the invention.

The stop 145 is attached to the recessed side 130 of the cup 125. In FIG. 8 a plurality of mounting holes 149 are provided in the outer wall of the double-walled cup 125. Screws 148 may be threaded into a pair of holes to secure the stop 145 to the cup 125 at a height that allows the drawer 200 to be inserted fully into the compartment 150. Fasteners (i.e., attachments) other than screws, such as, but not limited to snap fit connections, rivets, welds and glue may be used in addition to or in lieu of the screws 148. Full insertion, as used herein, is achieved, when the drawer 200 is inserted into the compartment, with the bottom of the drawer 200 being contained in the compartment, even if the top of the drawer 200 extends slightly beyond the top of the compartment 150 to the stop 145. Unused holes 149 may optionally be plugged or omitted from the structure.

The base 120 of the compartment module includes a shall cup-like structure 123 with a flange 121. The cup-like structure 123 is sized to securely fit into the bottom 108 of the outer cover 105. Thus, the outer diameter of the cup-like structure 123 is about the same as the inner diameter of the bottom 108 of the outer cover 105. The flange 121 has a larger diameter. In the exemplary embodiment illustrated in the Figures, the flange 121 has an outer diameter that is about the same as the outer diameter of the bottom 108 of the outer cover 105. Thus, the cup-like structure 123 of the base 120 can be inserted into the bottom 108 of the outer cover 105 up to the flange 121, and not beyond the flange 121.

For structural support, a pair of gussets 151 are provided. The gussets 151 extend from the bottom of the compartment 150 to the interior surface of base 120, the interior surface being the surface of the base 120 that faces the bottom 128 of the cup 125. Such gussets 151 are optional.

The compartment 150 may be integrally formed with the base 120. Alternatively, the compartment 150 may be separately formed and attached to the base 120. Such attachment may be achieved by glue or other bonding agent or welding (e.g., ultrasonic, laser, electrothermal or chemical welding). Such attachment may alternatively be achieved by mechanical coupling, such as with screws, rivets, snap-fit connections or any other means of attachment. The invention is not limited to any particular attachments or to integral or separate formations.

Figure 4:
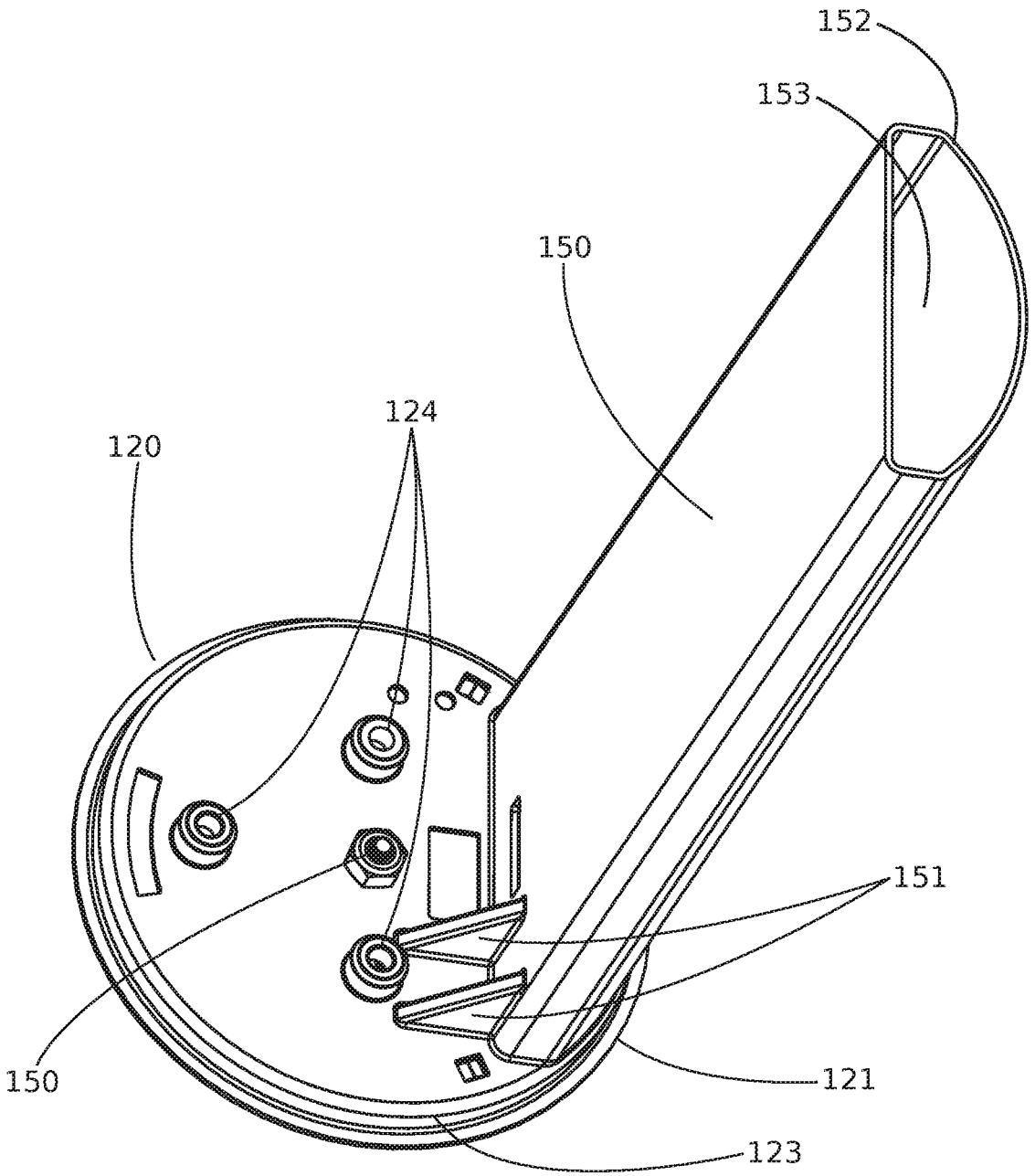
FIG. 4 is a first perspective view of an exemplary compartment module for a drinking vessel according to principles of the invention.

As shown in FIG. 4, the exemplary compartment 150 has a hollow D-shaped cross sectional shape (i.e., the compartment defined by the elongated hollow structure has a D-shaped cross-section). Such a shape is preferred because it provides a generally planar side to abut the recessed side 130 of the cup 125 and a curved side that does not extend outwardly beyond the maximum outer diameter of the cup 125. Thus, the outer cover 105 does not require any outwardly bulging cavity to accommodate the compartment 150 in the space 135 between the outer cover 105 and the recessed side 130.

Figure 5:
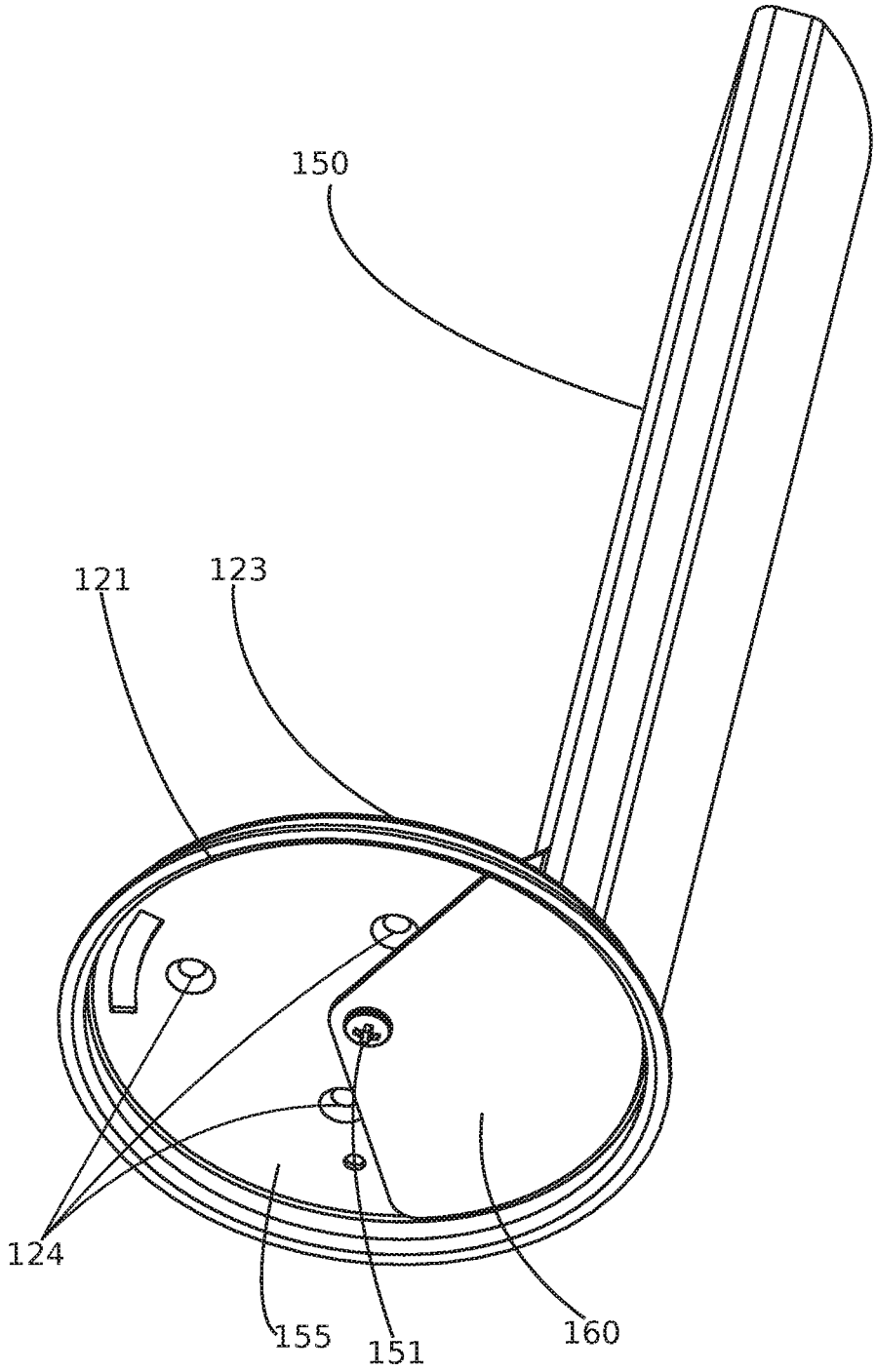
FIG. 5 is a second perspective view of an exemplary compartment module for a drinking vessel according to principles of the invention.
Figure 5A:
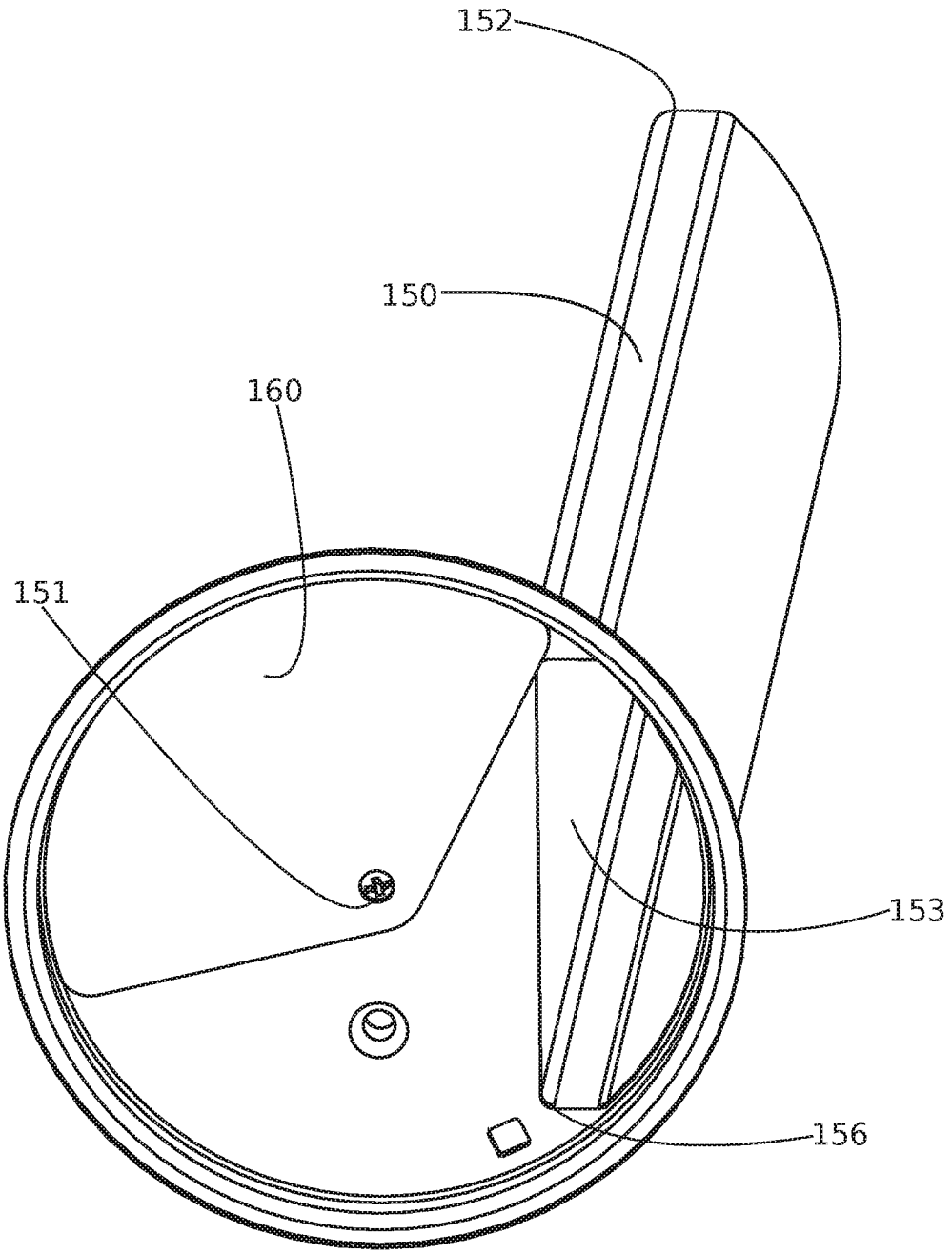
FIG. 5A is a third perspective view of an exemplary compartment module for a drinking vessel according to principles of the invention.

As shown in FIGS. 5 and 5A, a closure 160 comprised of a pie-shaped panel. The closure pivots about an axis. The axis is defined by the screw 151 near the center of the bottom 155 of the base 120. A rivet or pin may be used in lieu of a screw. The closure may be pivoted between a closed position and an open position. When the closure 160 is in a closed position as shown in FIG. 5, the closure 160 covers and conceals an opening 156 in the bottom 155. When the closure 160 is pivoted to an open position as shown in FIG. 5A, an opening 156 is exposed in the bottom 155. The opening 156 leads to the interior space 153 of the compartment 150. To slide the drawer 200 into the interior space 153 of the compartment 150, the closure 160 must be in the open position. Likewise, to remove the drawer 200 from the interior space 153 of the compartment 150, the closure 160 must be in the open position. To maintain the drawer 200 in the interior space 153 of the compartment 150, the closure 160 should be in the closed position.

Closures other than a pivoting pie shaped panel may be used, within the scope of the invention. Such other closures may include removable snap fit closures, resilient plugs, and hinged doors. In each case, the closure may cover the opening 156 and be moved or removed into an open position that exposes the opening 156.

Figure 12:
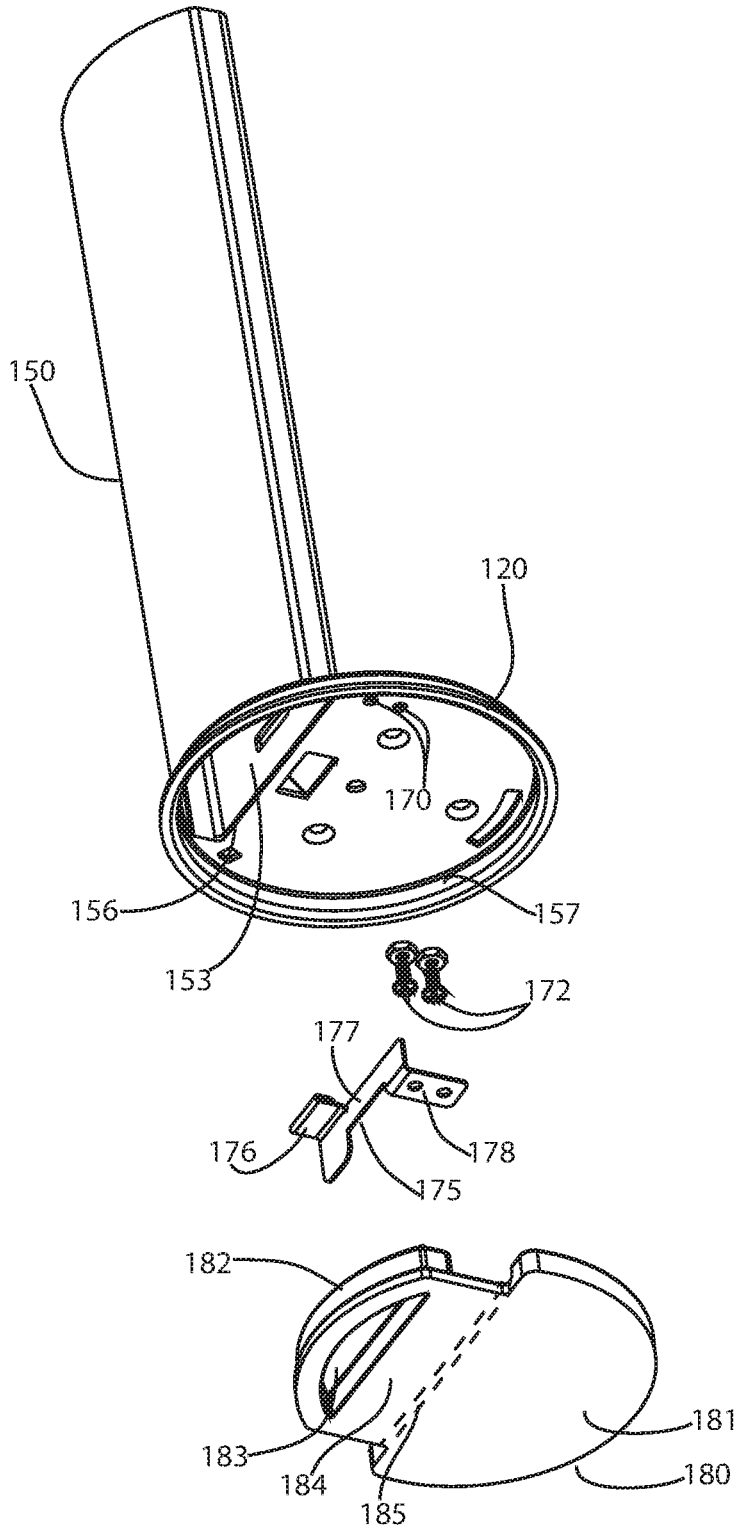
FIG. 12 is a perspective view of another exemplary compartment module for a drinking vessel according to principles of the invention.
Figure 13:
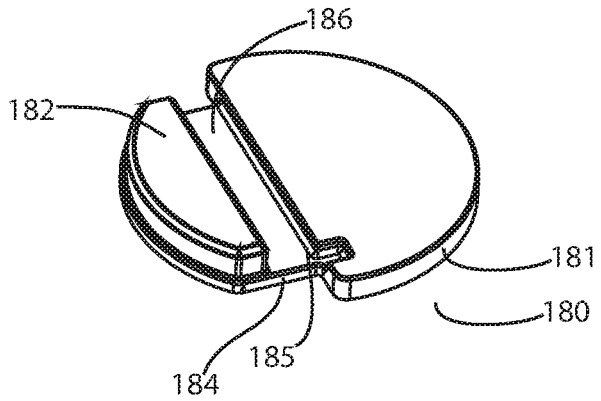
FIG. 13 is a perspective view of an exemplary bottom closure for the compartment module of FIG. 12.

Referring to FIGS. 12 and 13 an alternative closure 180 is conceptually illustrated. The exemplary closure 180 is comprised of a flexible, resilient elastomer, such as rubber or silicone. The closure includes a main body 181, sized and shaped to be securely received in the cavity 157 at the bottom of the base 120. The main body 181 may be bonded in the cavity, mechanically fastened in the cavity, held in place by friction or otherwise secured in the cavity. A flap 184 extends from the main body 181. A fillet 185 transitions the main body 181 to the flap 184. The flap 184 includes a plug 182 that is sized and shaped to fit snugly within the opening 156. The flap 184 also includes a recess 183 for fingertip access. The recess 183 is formed opposite the plug 182. The flap 184, excluding the plug 182 is thinner than the main body 181. The flap 184 is readily bendable between the plug 182 and main body 181. This portion 186 of the flap 184 (i.e., the portion between the plug 182 and main body 181) serves as a hinge, which allows the plug to be removed and inserted into the opening 156.

A plug stop 175 attaches to the base 120 with screws 172 and holes 170. The plug stop 175 includes a mounting tab 178, a main panel 177 and a flange 176. The main panel 177 abuts the flat side of the D-shaped opening 156. The flange 176 resides in the compartment space 153 a distance from the opening 156 equal to about the thickness of the plug 182. Thus, the flange 176 resists further insertion of the plug 182. This ensures that the plug is not inadvertently inserted too deep into the compartment space 153.

Figure 3:
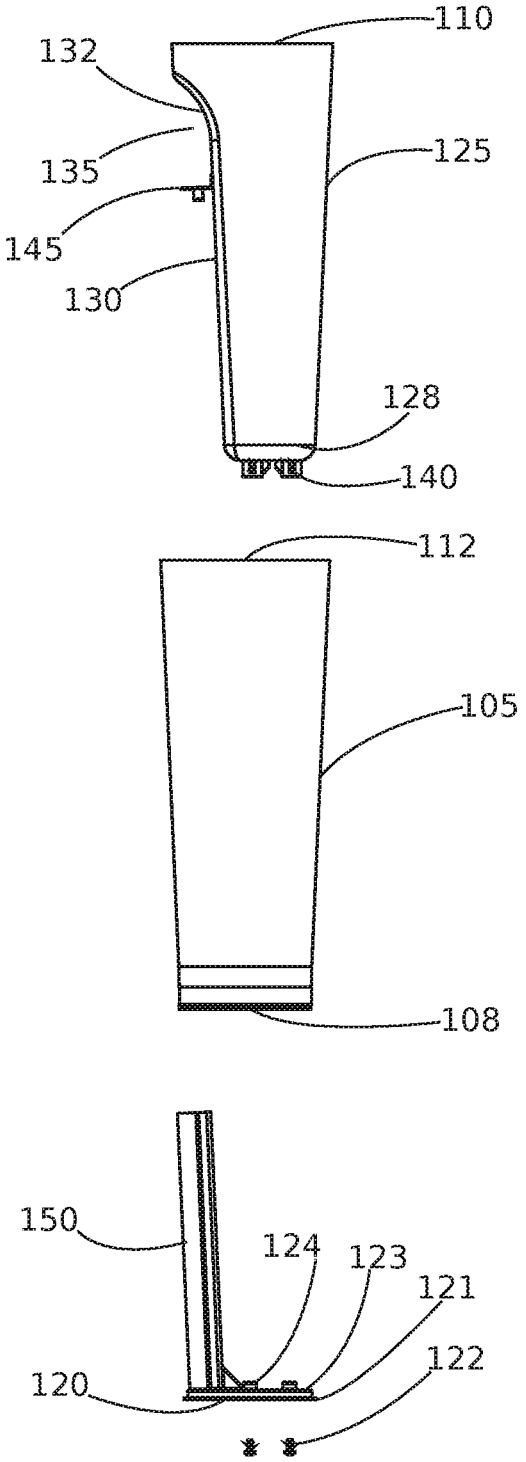
FIG. 3 is an exploded side view of an exemplary drinking vessel according to principles of the invention.
Figure 11:
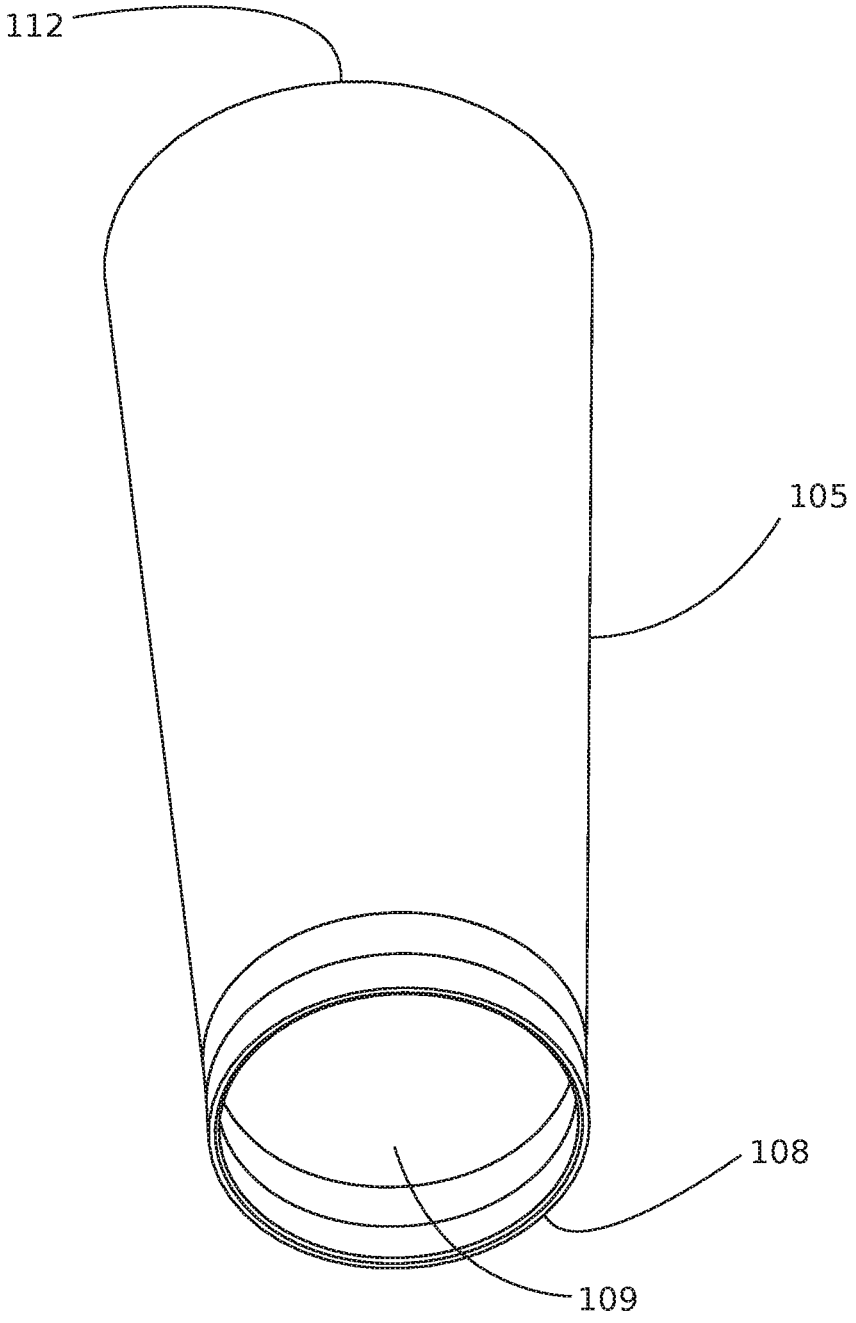
FIG. 11 is a perspective view of an outer cover for a drinking vessel according to principles of the invention.

Referring to FIGS. 3 and 11, the outer cover 105 is a hollow frustum that includes an open top 112 and an open bottom 108 and an interior space 109 extending from the open top 112 to the open bottom 108. The diameter of the cover 105 at the top 112 is greater than the diameter of the cover at the bottom 108. The inner diameter of the cover 105 at the top 112 is about the same as the outer diameter of the cup 125 at the top 110. The inner diameter of the cover 105 at the bottom 108 is about the same as the outer diameter of the cup 125 at the bottom 128. The length of the cover 105 from top 112 to bottom 108 is slightly greater than the length of the cup 125 from the top 110 to the bottom of the sockets 140, allowing the sockets 140 to be contained in the cover 105.

Figure 6:
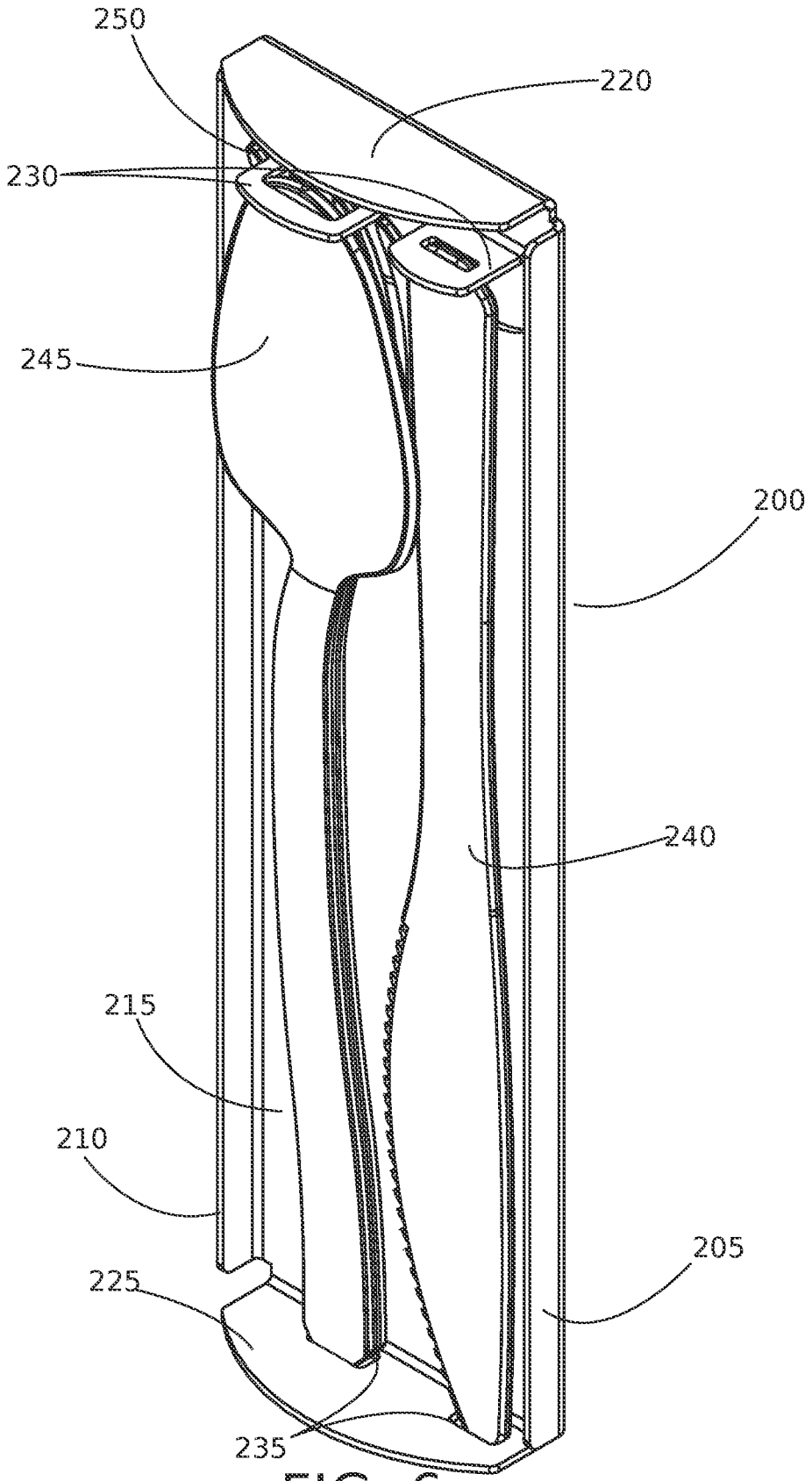
FIG. 6 is a perspective view of a drawer with stored utensils for a drinking vessel according to principles of the invention.
Figure 7:
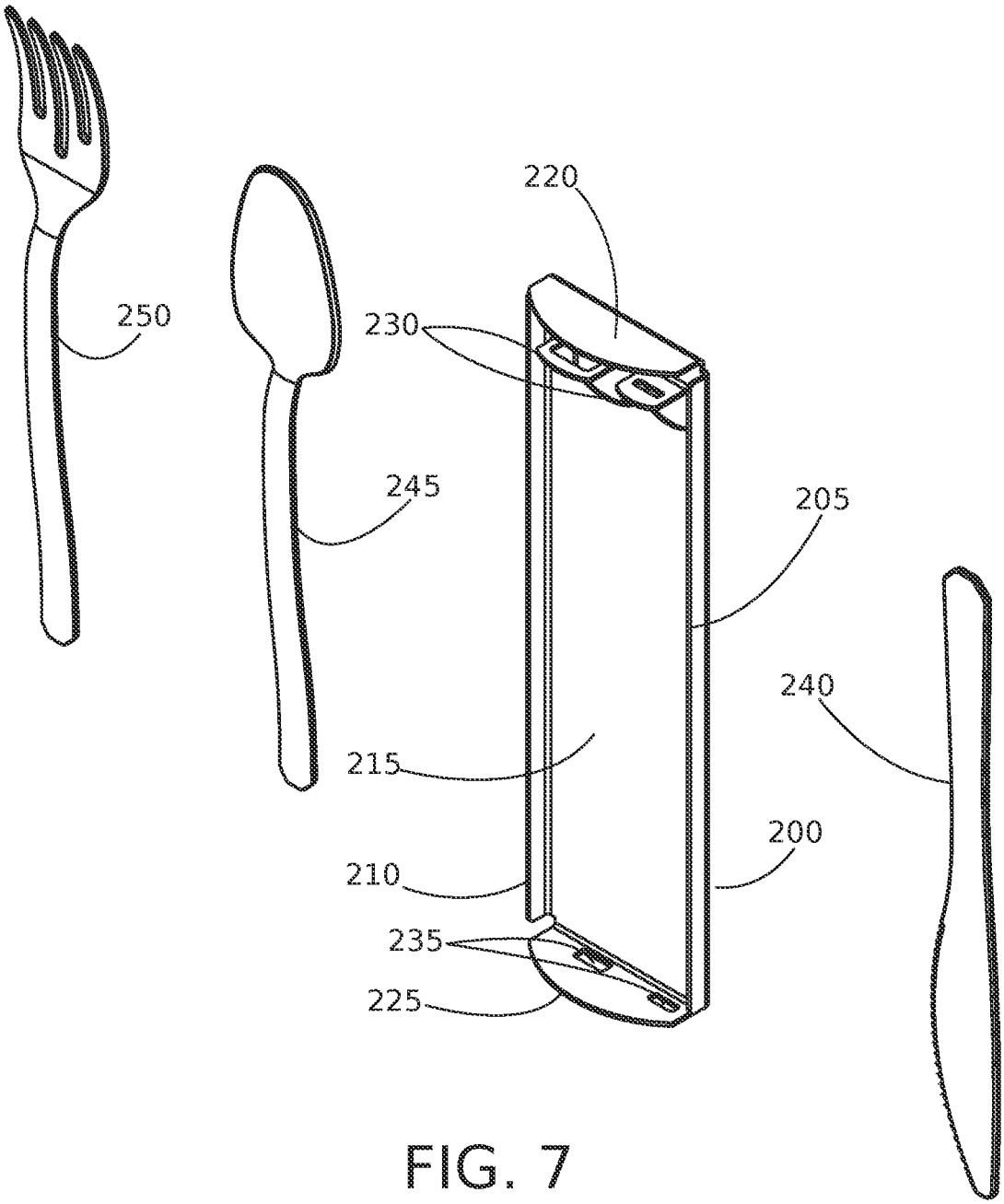
FIG. 7 is an exploded view of a drawer and utensils for a drinking vessel according to principles of the invention.

FIGS. 6 and 7 conceptually illustrate an exemplary drawer 200 comprised of a panel 215 and a top 220 (i.e., a top flange), a bottom 225 (i.e., a bottom flange), and a pair of sides 205, 210 extending from the panel 215 at an angle of 90° relative to the plane of the panel 215 (i.e., orthogonal to the plane of the panel 215) at the top, bottom and sides of the panel, respectively. The top 220 and bottom 225 are substantially parallel. The sides 205, 210 are substantially parallel to each other and orthogonal to the top 220 and bottom 225.

The panel 215 of the drawer 200 is sized to receive utensils. In the exemplary embodiment, the utensils include a spoon 245, fork 250, and knife 240. However, the invention is not limited to any particular utensils. Other utensils, such as, but not limited to, a straw, a spork (combination fork and spoon), a spife (combination spoon and knife), a spatula, and chopsticks, may be stored on the drawer 200 in addition to, or in lieu of, any of the utensils shown in FIGS. 6 and 7, without departing from the scope of the invention. The utensils may be comprised of any suitable material, including, without limitation, plastic or metal. In a preferred embodiment, the utensils are washable and reusable.

The drawer 200 includes retention elements for releasably securing the utensils to the panel 215 of the drawer 200. In FIGS. 6 and 7, the retention elements comprise a pair of upper slotted tabs 230 and slots 235 in the bottom 225 of the drawer. Bottom and top edges of the utensils are received in the slots of the upper slotted tabs 230 and in the slots 235 in the bottom 225. The distance between the upper slotted tabs 230 and in the slots 235 in the bottom 225 is slightly less than the overall lengths of the utensils. To receive the bottom and top edges of the utensils in the slots of the upper slotted tabs 230 and in the slots 235 in the bottom 225, the upper slotted tabs 230 and/or the bottom 225 are flexible plastic. By way of example, the upper slotted tabs 230 may be deflected to receive and release the engaged utensils. The upper slotted tabs 230 are below the top 220 of the drawer 200. The leaf spring 146 of the drawer stop 145, which exerts force against the top 220 of the drawer 200, could potentially dislodge the utensils if slots were formed in the top 220 of the drawer 200.

Retention elements other than upper slotted tabs 230 and slots 235 in the bottom 225 may be utilized without departing from the scope of the invention. Such other retention elements may include, snap fit retainers that extend from the panel 215 and grip the handles of utensils. As another example, magnets may be applied to the utensils and/or drawer to releasably retain utensils. As yet another example, the panel of the drawer may be equipped with molded pockets shaped to snugly receive each utensil. These and other retention elements may be used without departing from the scope of the invention.

The stored utensils extend outwardly from the panel 215 of the drawer 200 a distance that is determined by the thickness and shape of the utensils. This distance is preferably less than the maximum distance by which the top 220 and bottom 225 extend from the panel 215. Thus, the panel 215, top 220 and bottom 225 keep the stored utensils from contacting the interior walls of the compartment 150 when the drawer 200 is in the compartment space 153. This configuration helps reduce soiling the interior walls of the compartment 150 by used utensils stored in the drawer 200. A user may fully clean utensils immediately after use, or wipe utensils with a napkin and clean them fully later, or store the used utensils, uncleaned, in the drawer 200 for fully cleaning later. Regardless of which approach a user takes, the configuration of the drawer 200 helps maintain cleanliness of the compartment 150.

With reference to FIG. 3, a drinking vessel assembly according to principles of the invention is assembled by inserting the cup 125 with the drawer stop 145 into the cover 105 from the top 112 of the cover 105. The compartment module is inserted with the compartment 150 entering the space 135 between the recessed side 130 and the interior wall of the cover 105. The base 120 is secured to the sockets 140 at the bottom 128 of the cup 125. The panel 160 is pivoted to the open position. The drawer 200 containing utensils 240-250 is slid through the opening 156 into the interior space 153 of the compartment 150, until the top 220 contacts the drawer stop 145 and can move no further. Then the panel 160 is pivoted to the closed position.

To remove utensils, the panel 160 is pivoted to the open position. The leaf spring 146 urges the drawer 200 away from the drawer stop 145 until the leaf spring is fully uncompressed. This causes the bottom portion of the drawer 200 to extend out from the opening 156. The user may grab the portion of the drawer 200 extending outwardly and pull the drawer 200 from the compartment 150. Then utensils 240-250 may be removed from the drawer as desired. The drinking vessel may be used with the drawer 200 removed from or contained in the compartment. The drinking vessel may be used with the drawer 200 removed and the panel 160 in the open or closed position. The drinking vessel may be used with the drawer 200 contained in the compartment and the panel 160 in the closed position.

To replace utensils after cleaning or use, the panel 160 is pivoted to the open position. If the drawer 200 is contained in the compartment 150, the leaf spring 146 urges the drawer 200 away from the drawer stop 145 until the leaf spring is fully uncompressed. This causes the bottom portion of the drawer 200 to extend out from the opening 156. The user may grab the portion of the drawer 200 extending outwardly and pull the drawer 200 from the compartment 150. Then utensils 240-250 may be inserted into the drawer as desired. The drawer 200 containing utensils 240-250 is then slid through the opening 156 into the interior space 153 of the compartment 150, until the top 220 contacts the drawer stop 145 and can move no further. Then the panel 160 is pivoted to the closed position.

Figure 14:
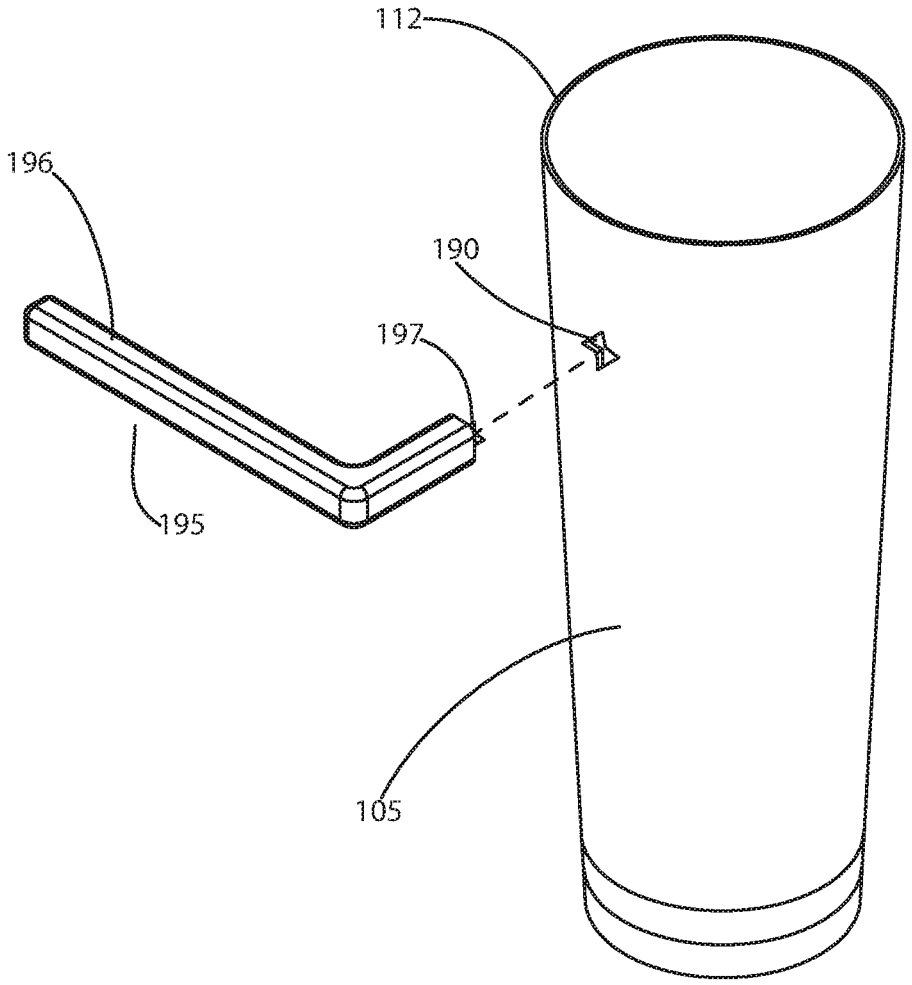
FIG. 14 is a first perspective view of an outer cover with a removable handle for a drinking vessel according to principles of the invention.
Figure 15:
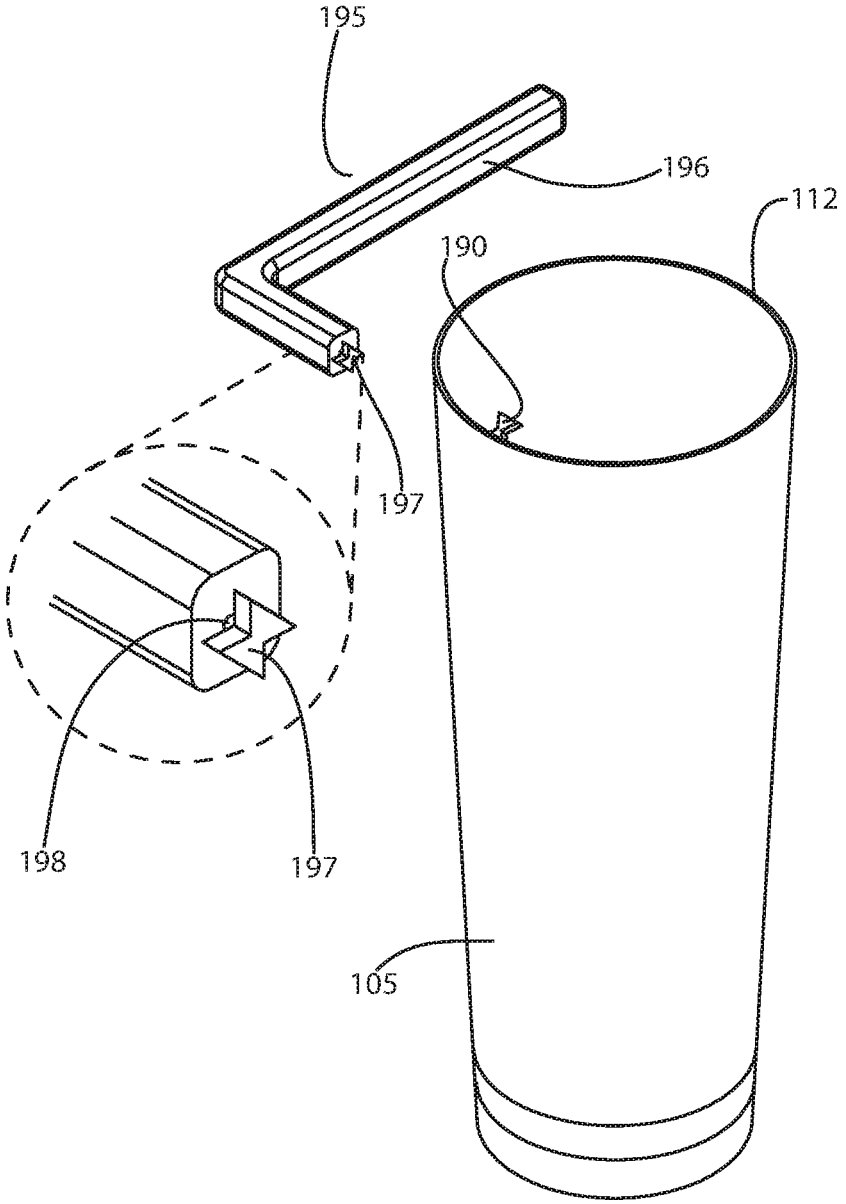
FIG. 15 is a second perspective view of an outer cover with a removable handle for a drinking vessel according to principles of the invention.
Figure 16:
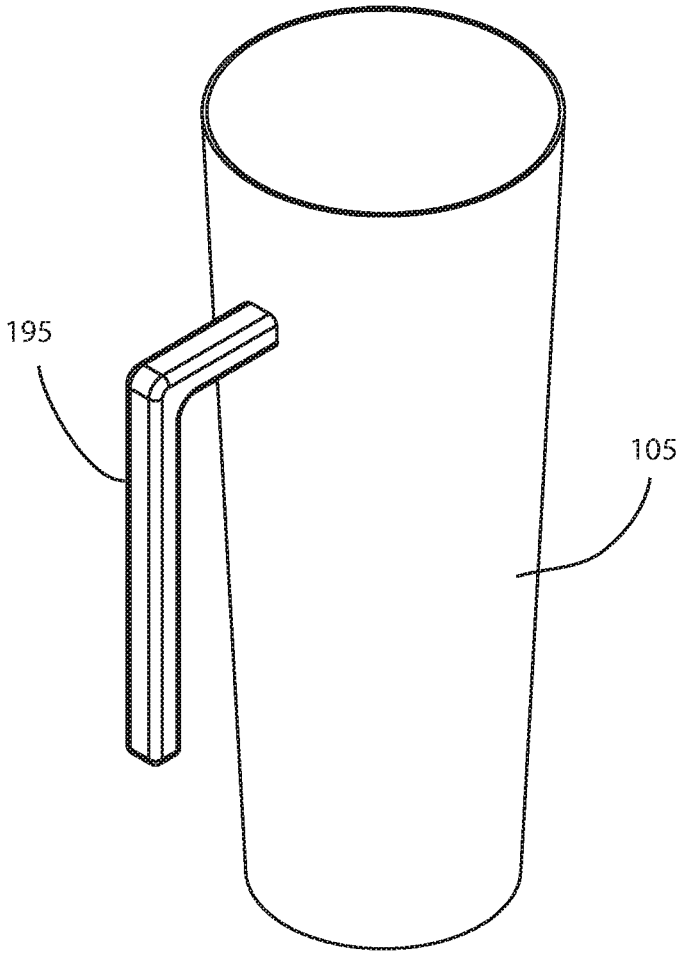
FIG. 16 is a third perspective view of an outer cover with a removable handle for a drinking vessel according to principles of the invention.

Referring to FIGS. 14-16, an embodiment of the outer cover 105 with a removable handle 195 is conceptually illustrated. The handle 195 may be removed to facilitate storage of the drinking vessel in a cup holder, such as a cup holders of a vehicle. The handle 195 includes a grip 196 and a handle plug 197 that mates with an aperture 190 in the outer cover 105. The handle plug 197 has a cross-section shape that is not circular. The handle plug 197 fits into the aperture 190, only when the handle 195 is oriented for insertion. After such insertion, the handle may be rotated 90°. Upon such rotation, the handle plug 197 cannot be dislodged from the aperture 190. A shank 198 connects the handle plug 197 to the handle grip 196. The length of the shank 198 is about the thickness of the outer cover 105 at the aperture 190, or only slightly greater than the thickness. The diameter or maximum width of the shank is less than the width of the aperture 190, to allow pivoting rotation of the handle 195. The handle 195 may be removed by pivoting the handle to the insertion position, so that the handle plug 197 aligns with the aperture 190. Upon such alignment, the handle plug 197 may be withdrawn from the aperture 190.

Figure 17:
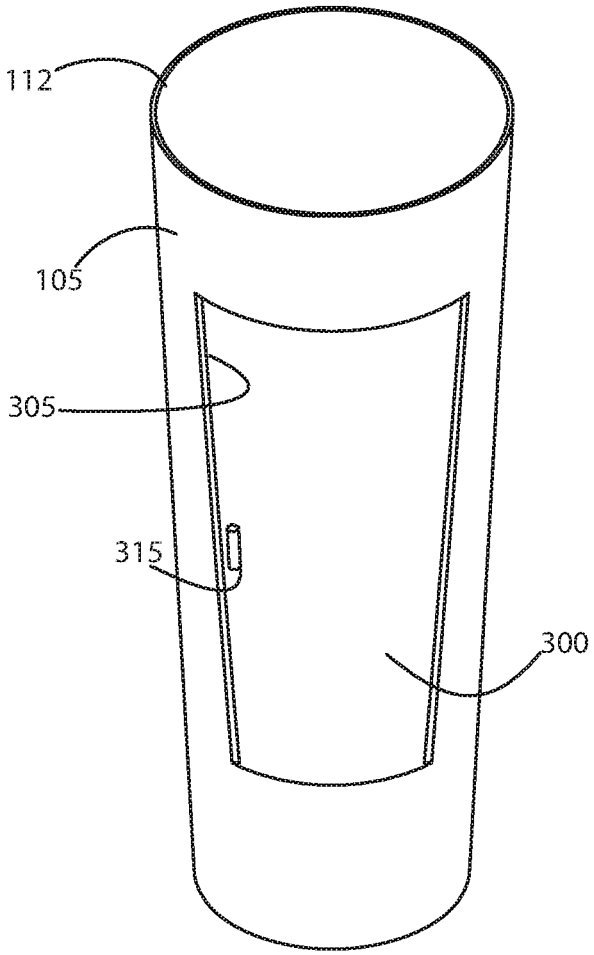
FIG. 17 is a first perspective view of an outer cover with a sliding door according to principles of the invention.
Figure 18:
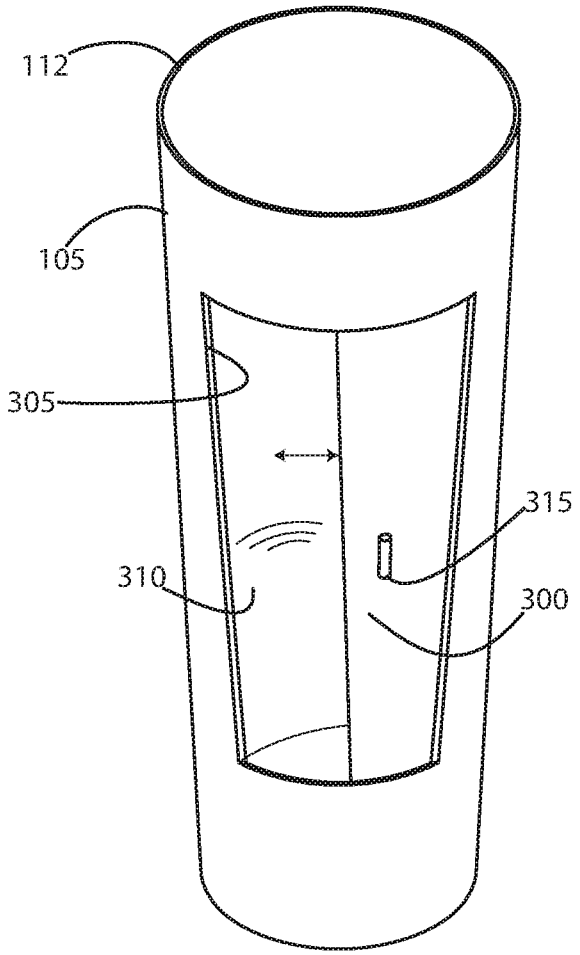
FIG. 18 is a second perspective view of an outer cover with a sliding door according to principles of the invention.
Figure 19:
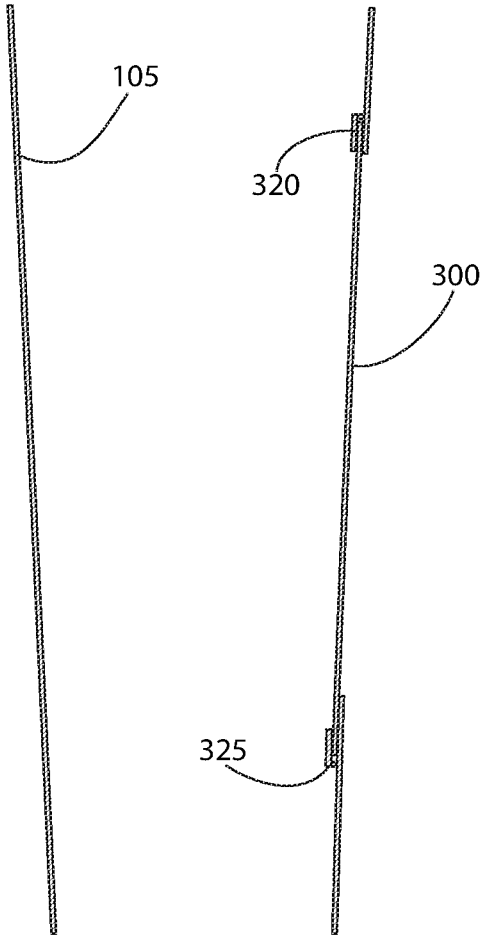
FIG. 19 is a cross-section view of an outer cover with a sliding door according to principles of the invention.

Referring to FIGS. 17-19, an alternative embodiment with a sliding door 300 is conceptually illustrated. The outer housing 105 includes a doorway 305. A door 300 covers the doorway 305 when the door 300 is slid into the closed position, as conceptually illustrated in FIG. 17. The door 300 may be opened by sliding motion. As the door 300 has substantially the same contour as the portion of the outer housing 105 with the doorway 305, the door 300 may slide and abut the inner side of the outer cover 105. When the door 300 is slid into the open position as shown in FIG. 18, a compartment 310 is revealed, which may house the drawer 200 and utensils. The door 300 is retained against the inner side of the outer cover 105 by a pair of tracks, i.e., upper track 320 and lower track 325, which are conceptually illustrated in the cross-section view of FIG. 19. A protuberance 315, fingertip recess or knurled portion facilitates fingertip grip to slide the door 300 for opening and closing. The protuberance 315 also limits the range of movement of the door. Detents and other door stops may be used to indicate and register closed or open configurations.

While an exemplary embodiment of the invention has been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. A drinking vessel assembly comprising:

a cup having an open top leading to a first space for containing a liquid, a bottom, a recessed side extending from the bottom a base abutting the bottom of the cup; to a transition between the top and the bottom;

a cover with a circular cross-section shape, the cover including an open top, an open bottom and an interior space extending from the open top to the open bottom, the cover being sized and shaped to receive and contain the cup, and a portion of the base being received in the open bottom of the cover, and a second space being defined between the recessed side and the cover;

the base including an opening leading to the second space;

a drawer, the drawer being sized and shaped to slide through the opening in the base; and at least one utensil releasably attached to the drawer.

2. The drinking vessel assembly according to claim 1, further comprising a compartment module comprising an elongated hollow structure defining a compartment and extending from the base and against the recessed side of the cup; and the compartment defined by the elongated hollow structure having a D-shaped cross-section.

3. The drinking vessel assembly according to claim 2, the drawer being sized and shaped to slide through the opening in the base and into the compartment defined by the elongated hollow structure.

4. The drinking vessel assembly according to claim 1, further comprising at least one utensil and a plurality of attachments releasably attaching the at least one utensil to the drawer.

5. The drinking vessel assembly according to claim 4, the at least one utensil comprising at least one utensil from the group consisting of a fork, a spoon, a knife, a straw and a pair of chopsticks.

6. The drinking vessel assembly according to claim 4, the plurality of attachments including a slotted flexible tab.

7. The drinking vessel assembly according to claim 1, the drawer including a drawer panel having a top end and a bottom end, a top flange extending orthogonally from the top end of the drawer panel, and a bottom flange extending orthogonally from the bottom end of the drawer panel.

8. The drinking vessel assembly according to claim 7, the drawer further including a pair of side flanges, the side flanges being perpendicular to the top flange and the bottom flange.

9. The drinking vessel assembly according to claim 1, the drinking vessel assembly further comprising a drawer stop attached to the recessed side of the cup, the drawer stop comprising a structure that impedes insertion of the drawer beyond the drawer stop.

10. The drinking vessel assembly according to claim 9, the drawer stop further comprising a spring extending from the drawer stop towards the bottom of the cup.

11. The drinking vessel assembly according to claim 10, the spring comprising a leaf spring.

12. The drinking vessel assembly according to claim 10, the drawer stop comprising a vertical panel and a horizontal panel extending perpendicular from the vertical panel.

13. The drinking vessel assembly according to claim 12, the spring comprising a leaf spring, and the leaf spring being integrally formed with the horizontal panel.

14. The drinking vessel assembly according to claim 1, a closure over the opening in the base.

15. The drinking vessel assembly according to claim 14, the closure comprising a pivoting panel, the panel be movable from a closed position covering the opening in the base to an open position exposing the opening in the base.

16. The drinking vessel assembly according to claim 14, the closure comprising a hinged panel, the panel be movable from a closed position covering the opening in the base to an open position exposing the opening in the base.

17. The drinking vessel assembly according to claim 1, further comprising a plurality of attachments securing the base to the bottom of the cup.

18. The drinking vessel assembly according to claim 1, the plurality of attachments comprising mating sockets and plugs.

19. A drinking vessel assembly comprising:

a cup having an open top leading to a space for containing a liquid, a bottom, a recessed side extending from the bottom to a transition between the top and the bottom;

an elongated hollow structure defining a compartment, the elongated hollow structure having an open top end, and the elongated hollow structure extending from the bottom of the cup and against the recessed side of the cup; and a base abutting the bottom of the cup and including an opening leading to the compartment; and a cover with a circular cross-section shape, the cover including an open top, an open bottom and an interior space extending from the open top to the open bottom, the cover being sized and shaped to receive and contain the cup, and the elongated hollow structure against the recessed side of the cup, a portion of the base being received in the open bottom of the cover; and a drawer, the drawer being sized and shaped to slide through the opening in the base and into the compartment defined by the elongated hollow structure; and at least one utensil and a plurality of attachments releasably attaching the at least one utensil to the drawer.

20. The drinking vessel assembly according to claim 19, further comprising a drawer stop attached to the recessed side of the cup between the open top end of the elongated hollow structure and the open top of the cup, the drawer stop comprising a structure that impedes insertion of the drawer beyond the drawer stop.

* * * * *